United States Patent [19]

Pernelle et al.

[11] Patent Number: 4,984,794

[45] Date of Patent: Jan. 15, 1991

[54] GOLF CLUB CAPABLE OF SELECTIVE ANGLE MODIFICATION BETWEEN THE SHAFT AND HEAD, AND METHOD OF ASSEMBLING THE GOLF CLUB

[75] Inventors: Andre Pernelle, Seynod; Jack Desbiolles, Annecy, both of France

[73] Assignee: Salomon S.A., Annecy Cedex, France

[21] Appl. No.: 346,557

[22] Filed: May 2, 1989

[30] Foreign Application Priority Data

May 2, 1988 [FR] France ..... 88 06187

[51] Int. Cl.[5] ..... A63B 53/02

[52] U.S. Cl. ..... 273/80.1; 273/80.2; 273/80.6

[58] Field of Search ..... 273/80.1–80.9, 273/80 C, 167 G, 80 R, 79; 403/4, 365, 361, 334

[56] References Cited

U.S. PATENT DOCUMENTS

| | | | |
|---|---|---|---|
| 648,256 | 4/1900 | Hartley | 273/79 |
| 796,802 | 8/1905 | Brown | 273/80.1 |
| 1,486,823 | 3/1924 | Allen | 273/79 |
| 1,879,117 | 9/1932 | Davidson | 273/79 |
| 1,940,168 | 12/1933 | Hillerich | 273/80.6 |
| 2,018,897 | 10/1935 | Reach | 273/80.4 |
| 2,027,452 | 1/1936 | Rusing | 273/80.1 X |
| 2,153,880 | 4/1939 | Barnhart | 273/80.4 |
| 2,219,670 | 10/1940 | Wettlaufer | 273/79 |
| 2,265,109 | 12/1941 | Birkhofer | 403/344 X |
| 2,425,808 | 8/1947 | Jakosky | 403/4 X |
| 3,625,513 | 12/1971 | Ballmer | 273/80.5 |
| 4,253,666 | 3/1981 | Murphy | 273/80.1 |

FOREIGN PATENT DOCUMENTS

| | | | |
|---|---|---|---|
| 49857 | 8/1970 | Australia . | |
| 472373 | 3/1951 | Canada | 273/80.7 |
| 1939371 | 2/1970 | Fed. Rep. of Germany . | |
| 800882 | 7/1936 | France . | |
| 1048806 | 8/1953 | France | 273/79 |
| 332354 | 7/1930 | United Kingdom | 273/80.3 |
| 3139 | 7/1931 | United Kingdom | 273/80.4 |
| 412662 | 7/1934 | United Kingdom | 273/80.5 |
| 518007 | 2/1940 | United Kingdom . | |
| 751323 | 6/1956 | United Kingdom | 273/79 |

*Primary Examiner*—Edward M. Coven
*Assistant Examiner*—Sebastiano Passaniti
*Attorney, Agent, or Firm*—Sandler, Greenblum & Bernstein

[57] ABSTRACT

A golf club and a method of assembling a golf club which includes a shaft having an assembly part for supporting a head of the club, and a head for attachment to the shaft, the head having an assembly part for engaging with the assembly part of the shaft. At the time of attachment of the head to the shaft, the head is selectively positionable at one of a plurality of angles. The present invention permits the golf club to be configured, e.g., as a function of the playing position of the golfer such that the head of the golf club is permitted to remain substantially flat with respect to the hitting surface.

32 Claims, 5 Drawing Sheets

GOLF CLUB CAPABLE OF SELECTIVE ANGLE MODIFICATION BETWEEN THE SHAFT AND HEAD, AND METHOD OF ASSEMBLING THE GOLF CLUB

BACKGROUND OF INVENTION

1. Field of the Invention

The present invention relates to a golf club in which the shaft and head have the capability of having the angle of "connection" of the shaft to the head modified. The present invention also relates to a method of assembling such a golf club.

2. Discussion of Background and Relevant Information

As shown in FIG. 1, a golf club 1 includes a shaft 2, typically metallic, and a head 3 connected to the shaft 1 by an extension 4 towards the top, referred to as the neck.

The assembly of the head and the shaft is generally achieved by nesting one within the other and bonding, particularly by gluing, of two assembly parts (not shown in FIG. 1) solidly affixed to the head and shaft and having complementary support zones.

The head 3 of the golf club constitutes the actual hitting element. So that the hit is correct, it is necessary that the head 3 of the club remain truly flat on the ground, the shaft 2 of the club thus forming an angle, alpha, with respect to the vertical.

The angle alpha, which can be defined either with respect to the vertical, as in the case of FIG. 1, or with respect to the horizontal, constitutes the angle called "connecting" angle, or angle of "connection" of the shaft.

One can easily understand that the angle of connection of a club varies with respect to the golfer and that it depends essentially on the position of play and on the stature of the golfer.

In the case of a club such as a putter, which is shown in FIG. 1, three principal angles of connection are generally defined corresponding to three positions A, B and C of the golfer, i.e., a median position A and two positions B and C offset approximately by 1.5° on both sides of the median position.

Thus one seeks, particularly in the case of precision clubs like putters, to be able to easily modify the connection angle of the golf club shaft so as to adapt it to the playing position of the golfer.

Currently, different solutions have been proposed to resolve this problem.

A first solution consists of obtaining the desired connection angle of the shaft at the time of molding it. Such a solution requires a large number of molds, since a mold is necessary for each connection angle, and is thus very expensive.

A second solution consists of obtaining the desired connection angle by deformation of the shaft, at the level of its connection with the head, after the assembly of the golf club.

Such a solution is unsatisfactory. In fact, in this case the aforementioned angle is only obtained by a significant malleable deformation of the shaft. Yet, as the shaft is generally made of tempered steel, such a deformation causes a fatiguing which often leads to the breaking of the shaft.

Furthermore, as the deformation is often done manually, the connection angle is not obtained with great precision.

SUMMARY OF THE INVENTION

Accordingly, it is an object of the present invention to overcome the disadvantages of prior art methods and devices by providing a golf club which includes:

(a) a shaft having a means for supporting a head, the supporting means being rigidly affixed to the shaft;

(b) a head for attachment to the shaft, the head having means for engaging the supporting means of the shaft;

wherein the supporting means of the shaft and the engaging means of the head include means for selectively positioning the shaft at one of a plurality of predetermined angles relative to the head as the shaft and the head are attached.

The shaft of the golf club of the present invention further includes an external assembly part and the supporting means of the shaft includes an internal surface area of the external assembly part. The head includes an internal assembly part and the engaging means of the head includes an external surface area of the internal assembly part such that the internal assembly part is receivable within the external assembly part.

Further according to the invention, the engaging means of the head includes means for engaging only a predetermined portion of the internal surface area of the external assembly part which varies in response to which of the plurality of predetermined angles the shaft is attached relative to the head.

According to one embodiment of the invention, the head includes an external assembly part and the shaft includes an internal assembly part, and the engaging means of the head includes projections formed on the external assembly part.

According to another embodiment of the invention, the head includes an external assembly part and the shaft includes an internal assembly part, and the supporting means of the shaft includes projections formed on the internal assembly part.

Still further according to the first embodiment of the invention, a plurality of the projections are provided for each of the plurality of predetermined angles, and the projections are substantially uniformly and angularly distributed on the periphery of the external assembly part of the head.

Still further, the plurality of projections provided for each of said plurality of predetermined angles equal two projections which are disposed substantially on opposite sides of the external assembly part of the head.

Still further, the external assembly part of the head includes a longitudinal axis, each of the plurality of projections which are provided for each of the plurality of predetermined angles includes a respective support surface envelope having a longitudinal axis which is inclined with respect to the longitudinal axis of the external assembly part of the head which corresponds to a respective one of the predetermined angles.

Still further, each of the support surface envelopes has a substantially conical configuration.

Still further, the supporting means of the shaft includes an internal support surface of the internal assembly part, and the internal support surface includes two substantially oppositely disposed, substantially flat surfaces.

Further according to the second embodiment, a plurality of the projections are provided for each of the plurality of predetermined angles, and the projections are substantially uniformly and angularly distributed on the periphery of the internal assembly part of the shaft.

Still further according to this embodiment, the plurality of projections provided for each of the plurality of predetermined angles equal two projections which are disposed substantially on opposite sides of the internal assembly part of the shaft.

Still further, the internal assembly part of the shaft includes a longitudinal axis; each of the plurality of projections which are provided for each of the plurality of predetermined angles includes a respective support surface envelope having a longitudinal axis which is inclined with respect to the longitudinal axis of the internal assembly part of the shaft which corresponds to a respective one of the predetermined angles.

According to a further aspect of the invention, a quantity of glue, preferably of the epoxy type, is utilized for affixing the external assembly part to the internal assembly part and is provided within the interstices between the external and internal assembly parts.

According to a further aspect of the invention, the external assembly part has an external surface which is substantially uninterrupted.

Still further, the substantially uninterrupted surface of the external assembly part is substantially smooth.

The present invention can be further defined as a head for a golf club for attachment to a shaft, wherein the head includes means for engaging a supporting means for the shaft, wherein said head includes a neck and the engaging means of the head includes at least three support projections arranged in series on each of two opposite sides of the head to define three pairs of engagement members for defining three respective ones of the plurality of predetermined angles between the shaft and the head.

According to this aspect of the invention, each of the three pairs of engagement members define in part a substantially conical envelope corresponding to an envelope defined in part by the internal surface area of the supporting means of the shaft.

Further according to this aspect of the invention, the substantially conical envelope defined by each of the pairs of engagement members has an angle of approximately 10°.

Still further, each of the substantially conical envelopes has a longitudinal axis, and adjacent ones of the substantially conical envelopes are positioned at an angle of approximately 1.5° with respect to each other.

Still further, the neck has a longitudinal axis, and one of the longitudinal axes of the substantially conical envelopes is substantially coaxial with the longitudinal axis of the neck.

According to a further aspect of the invention, a weakened zone is provided in the area of juncture of each of the support projections and the neck.

According to a still further aspect of the invention, the head is made of synthetic material.

Still further, the neck has a substantially oval crosssection.

Still further, the neck has a generally conical shape having flattened areas on opposite sides.

The method of the present invention includes the step of selectively positioning the shaft and the head at one of a plurality of predetermined angles as the shaft and the head are attached.

Further according to the method of the invention, the step of selectively positioning the shaft and the head includes inserting a portion of the head into a portion of the shaft.

Still further, the step of selectively positioning the shaft and the head includes modifying the engaging means of the head prior to attaching the shaft and the head.

Still further, the engaging means of the head includes a plurality of engaging members corresponding to each of the plurality of predetermined angles, and the step of modifying the engaging means of the head includes retaining only the ones of the engaging members which correspond to a desired one of the plurality of predetermined angles.

Still further, a quantity of glue is provided between the shaft and the head for retaining the head on the shaft.

BRIEF DESCRIPTION OF THE DRAWINGS

The invention will be better understood and other characteristics will become more clear by means of the description which follows, in reference to the annexed schematic drawing which illustrates, by way of a non-limiting example, a preferred embodiment, in which.

DETAILED DESCRIPTION OF A PREFERRED EMBODIMENT

An object of the present invention is to overcome the disadvantages mentioned above and to furnish an assembly process for a golf club, of the type in which the assembly is achieved by the nesting and joining of two assembly parts having support zones which are complementary and solidly affixed to the shaft and the head of the club; which is inexpensive to implement; which does not entail any deformation of the shaft or the club head; and which permits the achievement of a connection angle with great precision.

Another object of the present invention is to furnish an assembly process for a golf club which is compatible with new technologies of manufacturing the club head of synthetic material.

This end is attained by means of the process according to the invention by the fact that it consists of modifying the relative angular position of the two assembly parts at the moment of their being connected together.

In this way, the angular position of the head and shaft is modified at the time of their assembly, and an adjustment of the connection angle is obtained without any deformation of the shaft or any special tooling.

According to a preferred embodiment, the modification of the angular position is obtained by the modification of the support points of the lower assembly portion in the exterior subassembly part at the moment of the their being connected together.

Figure 2:
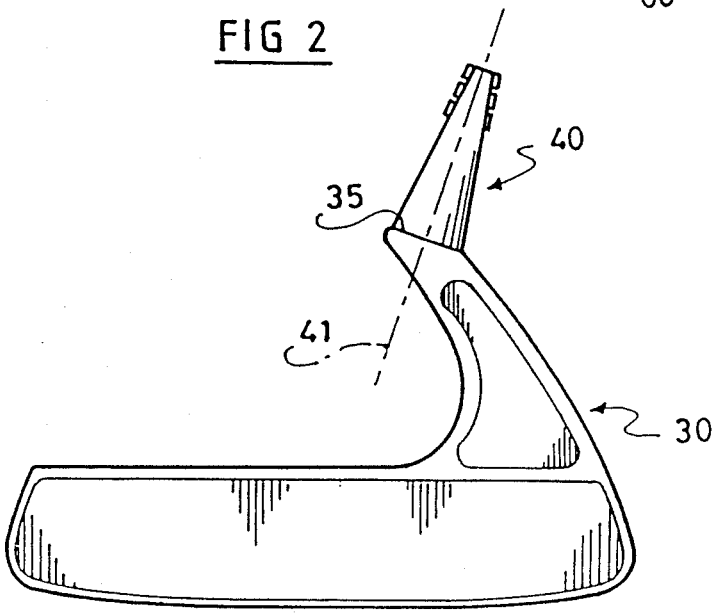
FIG. 2 is a side elevation view of the golf club before assembly.

FIG. 2 shows a golf club 10 assembled by means of the process according to the invention. This golf club 10 is constituted of a shaft 20, a head 30 and an optional assembly ring 60.

The shaft 20 is, in a manner known per se, formed from a metallic tube, generally of tempered steel. The shaft 20 is cylindrical along nearly its entire length, i.e., portion 21 from its upper end to the general proximity of its lower end.

At its lower end, the shaft 20 has an assembly part 22 with the head 30 of the club, and which constitutes the exterior assembly part of the club.

Figure 3:
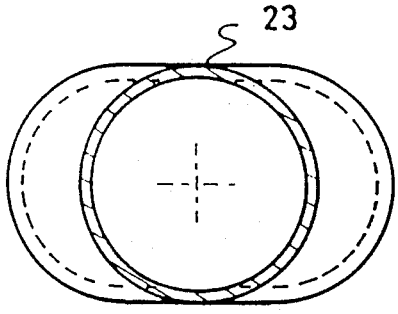
FIG. 3 is a cross-sectional view along III—III of FIG. 2.
Figure 3:
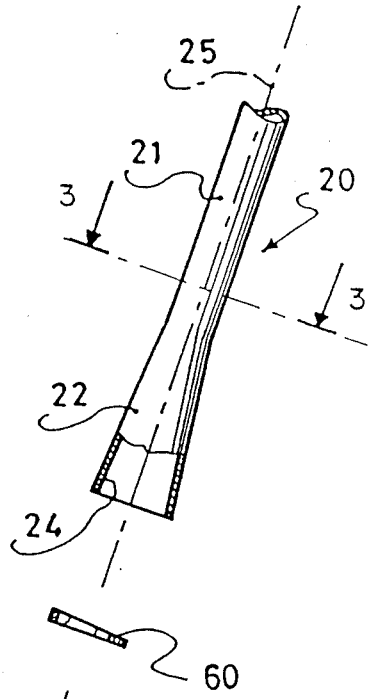

As FIG. 3 shows as well, the assembly part 22 has, on the exterior, a flattened conical shape on two diametrically opposed sides 23, which confers to it a slightly oval transverse section. This assembly part has likewise on the interior, because of the tubular shape of the shaft 20, a support surface 24 of a flattened conical shape on two diametrically opposed sides.

The two parts 21, 22 of the shaft 20 have, in addition, a single longitudinal axis 25.

The head 30 of the golf club, which in this case is that of a putter, has an extension towards the top which constitutes the neck 40 and which is separated from the head by a shoulder 35.

The neck 40, having longitudinal axis 41, is adapted to be inserted into the assembly part 22 of the shaft and constitutes the interior assembly part of the club.

Figure 4:
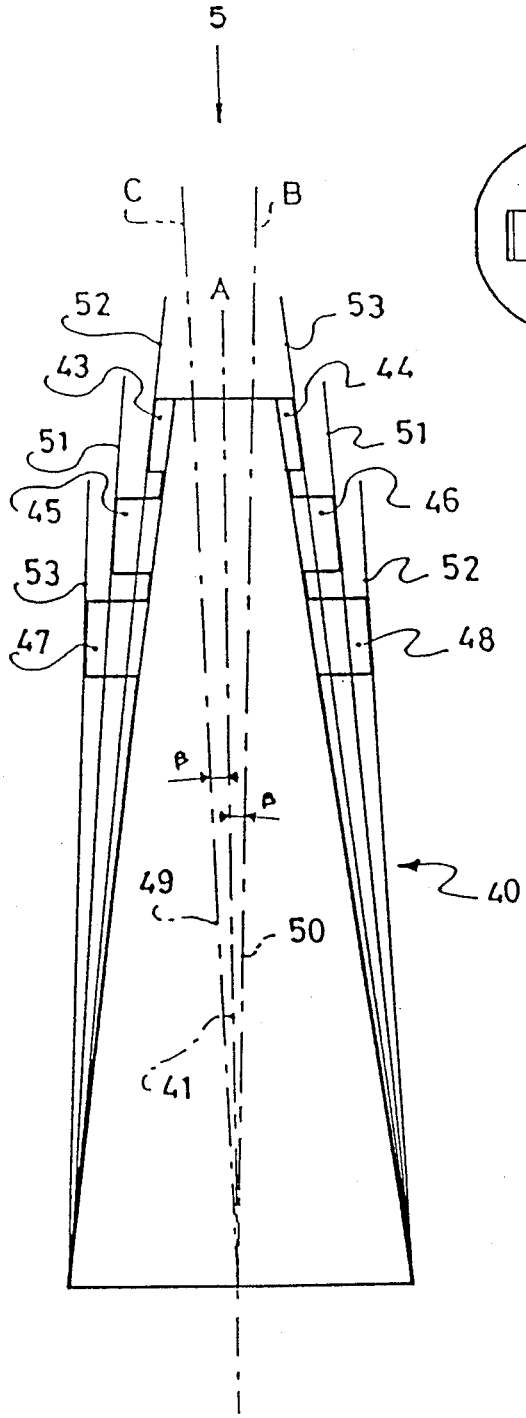
FIG. 4 is, in large-scale, a detailed view of the assembly part of the golf head.
Figure 5:
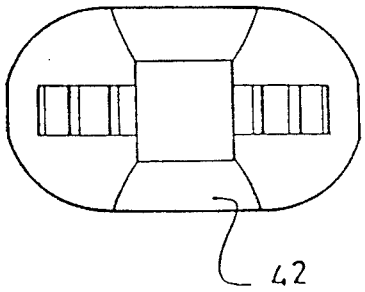
FIG. 5 is an end view according to arrow V of FIG. 4.
Figure 6:
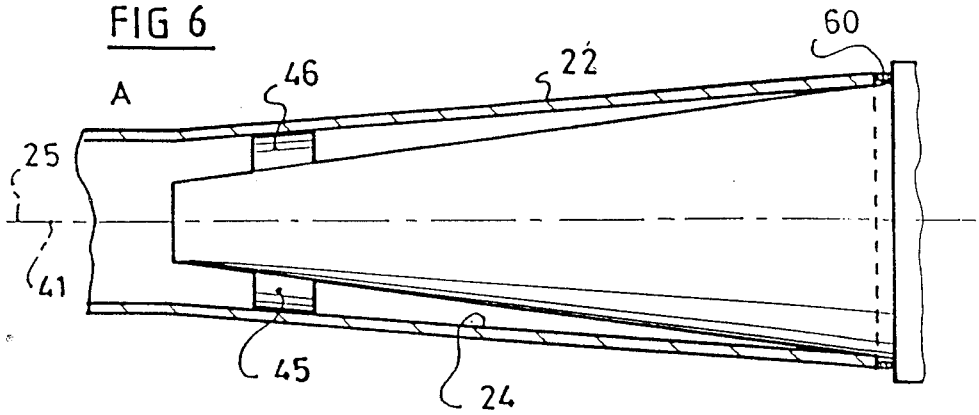
FIGS. 6, 7 and 8 are partial longitudinal cross-sectional views of the two nested assembly parts, illustrating different positions which can be obtained, the interior assembly part not shown in section.

As FIGS. 4 and 5 show, the neck 40 has a generally conical shape, flattened on two diametrically opposed sides 42, which confers to it a slightly oval transverse section. Such a flattened shape permits a substantially precise positioning of the two assembly parts 22, 40 during their nesting and, thus, is particularly advantageous. That is, the flattened surfaces 42 of the neck 40 engage corresponding flattened surfaces on the inner support surface 24 of assembly part 22, regardless of the final positioning of the head 30 relative to the shaft 20.

As is clearly shown in FIG. 2, the conical shapes of the two assembly parts 22, 40 are different, the cone angle of the inner assembly part 40 being greater than that of the exterior assembly part 22.

In the embodiment shown in the drawings, the cone angle of part 40 is approximately equal to 20°, while the cone angle of the part 22 is approximately equal to 10°.

As FIG. 4 shows, six projections of support 43, 44, 45, 46, 47 and 48 are provided on the exterior surface of the upper end of neck 40. These projections are arranged in series spaced along the longitudinal axis 41 of the neck 40 and, in ascending order from the upper end of the neck to the shoulder 35. The projections of each series are substantially diametrically opposed and are positioned on the curved portion of the neck casing 40.

These different projections 43, 44, 45, 46, 47 and 48 cooperate two by two to constitute different support points of the interior assembly part or neck 40 in the exterior assembly part 22 of shaft 20.

The two projections 45, 46 are constituted so as to define with the longitudinal axis 41 of the neck a conical envelope or casing 51 corresponding to the conical casing or envelope of the exterior support surface 24 of the assembly part 22.

In the present case, such a conical casing has a cone angle of approximately 10°.

The two projections 43, 48 are likewise constituted so as to define a conical envelope or casing 52 which corresponds to that of the surface 24 of the assembly part 22, but whose longitudinal axis 49 is inclined towards the right in FIG. 4, with respect to the longitudinal axis 41 of the neck.

In the case shown, the inclination angle beta of the axis 49 with respect to the axis 41 is approximately equal to 1.5°.

The two latter projections 44, 47 are finally constituted so as to define a conical envelope or casing 53 which corresponds to that of the surface 24 of the assembly part 22 and whose longitudinal axis 50 is inclined, towards the left in FIG. 4, by an angle beta with respect to the longitudinal axis 41, this angle beta being likewise approximately equal to 1.5°.

One will easily understand that it will be possible to modify the angular position of the shaft and the head of the club, on both sides of a median position, following the pairs of projections used to serve as support points during the assembly of the club.

Figure 1:
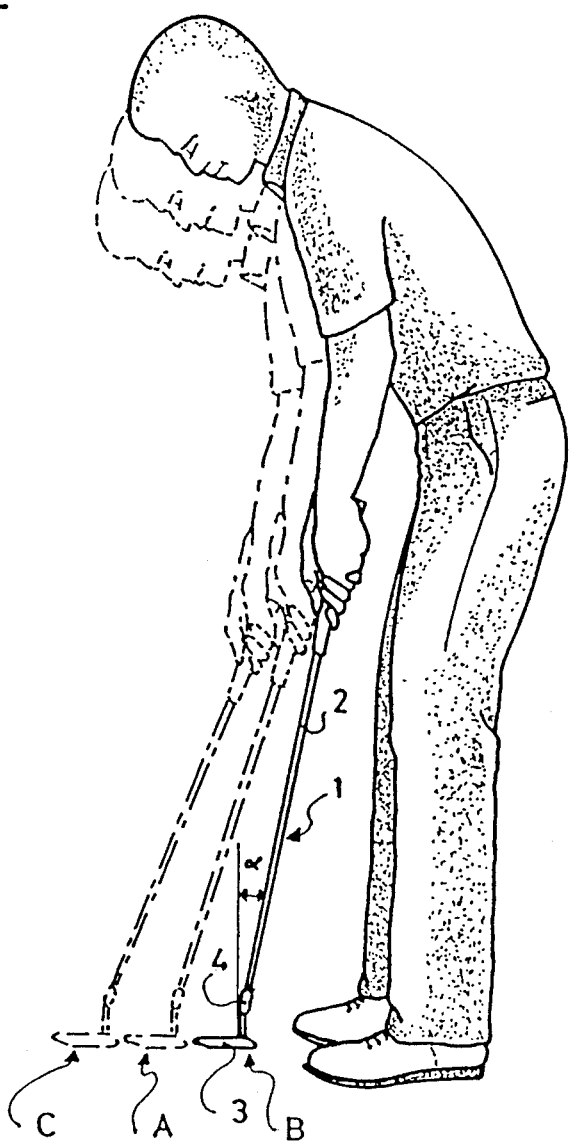
FIG. 1 illustrates the manner by which the angle between the head and the shaft of a golf club varies according to the position of play and the stature of the golfer.

In the present case each pair of support projections 45, 46; 43, 48; and 44, 47 correspond, respectively, to one of the positions A, B, and C depicted in FIG. 1, the pair of projections 45, 46 being associated with a "standard" median position A, while the two other pairs of support projections 43, 48 and 44, 47 are associated with positions B and C, respectively, offset by approximately 1.5° with respect to the median position.

The assembly of the club by means of the process according to the invention is accomplished in the following fashion.

First, the pair of projections to serve as the support is selected as a function of the angle of the desired connection, the other projections being removed.

For example, if one desires a "standard" connection angle, one would remove the projections 43, 44, 47 and 48 and would retain projections 45, 46.

The neck 40 of the club head is then introduced into the lower end 22 of the shaft until its support projections 45, 46 come to bear against the interior surface 24 of the shaft 20, the lower end of the latter then being in abutment against the shoulder 35.

At this moment, the neck 40 is perfectly coaxial to the shaft 20, its axis 41 being aligned with the axis 25 of the shaft.

The assembly is completed by means of a previously introduced glue in the assembly part 22 of shaft 20. This glue is preferably constituted by a resin of the epoxy type, such a material serving both as joining element and filling element for the space between the two assembly parts 22, 40. Of course, another means or element for joining can be provided as a function of the materials used.

Figure 7:
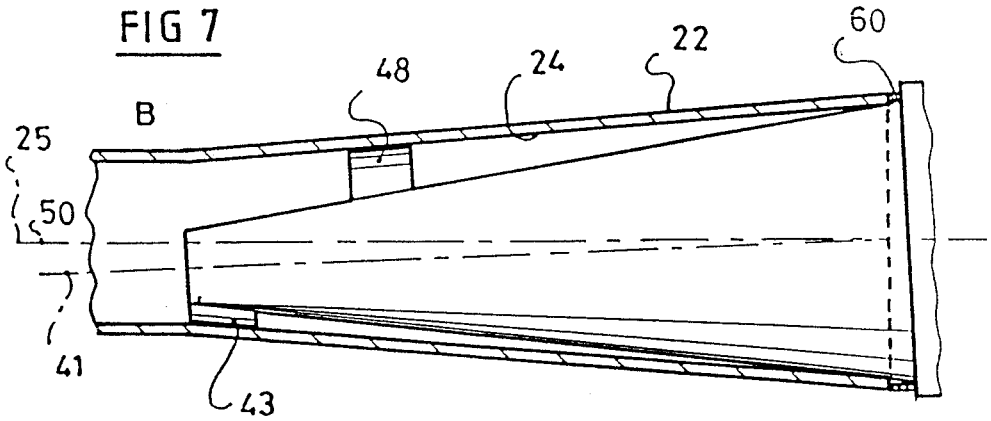
Figure 8:
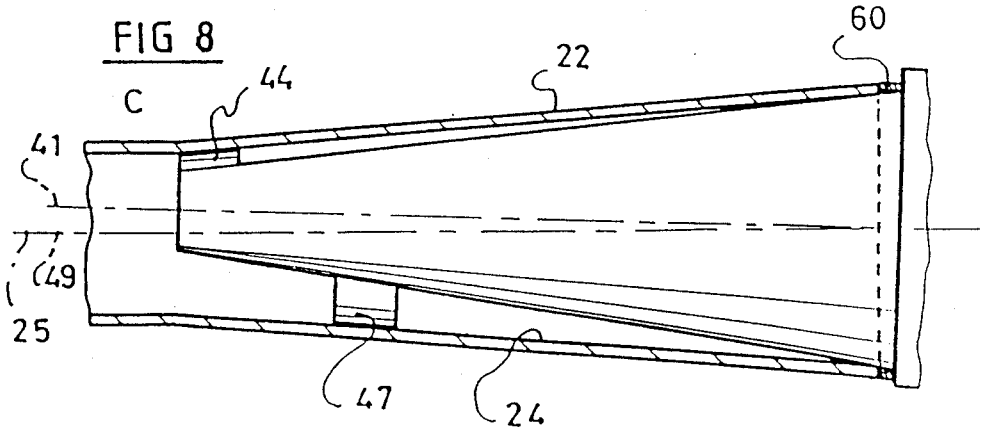

Likewise, if one desires a connection angle offset by plus or minus 1.5° with respect to the standard angle, it will suffice to retain only the pair of projections 43, 48 (that which makes it possible to obtain position B—see FIG. 7) or the pair of projections 47, 44 (that which makes it possible to obtain position C—see FIG. 8).

In effect, if one keeps only projections 47, 44, the support surface 53 of the neck within the assembly part 22 of the shaft will be inclined by the angle beta towards the left with respect to axis 41 of the neck. As a result, this axis 41 will be inclined by the same value towards the right with respect to the axis of shaft 20, after the nesting, which makes it possible to obtain position C (see FIG. 8).

Conversely, if only projections 43, 48 are retained, the support surface 52 of the neck within the assembly part 22 of the shaft will be inclined by the angle beta towards the right with respect to axis 41 of the neck and the latter will thus be inclined by the same value, towards the left after nesting, with respect to the axis of the shaft 20, which makes it possible to obtain position B (see FIG. 7).

In the above-mentioned two cases, an assembly ring 60 in the shape of a coin can be used to cover the space left between the shoulder 35 of the neck 40 and the lower edge of shaft 20, as indicated in FIGS. 7 and 8.

It will be noted that such an assembly process makes it possible to attain excellent precision of the connection angle since the support surfaces of the neck of the club head in the shaft are always perfectly defined by the projections.

Such an assembly is also more precise, especially as it is carried out in the final stage of manufacture, i.e., after the heat treatments which produce deformations.

This assembly process also makes it possible to avoid any malleable deformation of the shaft or neck of the head, and thus considerably reduces the risks of breaking the latter.

Finally, this assembly process is particularly adapted to the manufacture of clubs (especially putters) having a head of synthetic material which is not easily deformed.

Of course, such a process can likewise be used with heads of metallic clubs; in that case, it is advantageous to provide for zones of weaker resistance or preliminary breaks at the level of the junction of each projection 44, 45, 46, 47 and 48 with the neck 40 so as to facilitate the selective elimination of these projections.

Although described in connection with the assembly parts having a conical shape with oval section, such an assembly process can likewise be applied to the assembly of elements having cylindrical shapes or circular sections, even parallelepipedic.

However, it will be noted that the embodiment of the assembly surfaces described is particularly advantageous in the case where the head is of synthetic material since the oval section of the neck 40 at the level of the shoulder 35 has a more significant surface than a conventional circular section and, thus, has a greater resistance.

The assembly process described is not limited to the number or the value of connection angles described. Such a process can be used especially to obtain a lesser or greater number of connection angles or different connection angles.

It can also be easily understood that the number of support projections necessary to obtain each angle can be decreased or increased.

More particularly, a single projection can serve to define a position of the neck within the shaft with respect to a median position. Conversely, three or more projections can be associated with each position, these projections then being preferably distributed angularly in a regular fashion. However, the provision of two projections for each connection angle makes it possible to obtain an optimal "setting" effect of the neck within the shaft, particularly in the case where the latter has two flattened parts in the assembly zone.

Figure 9:
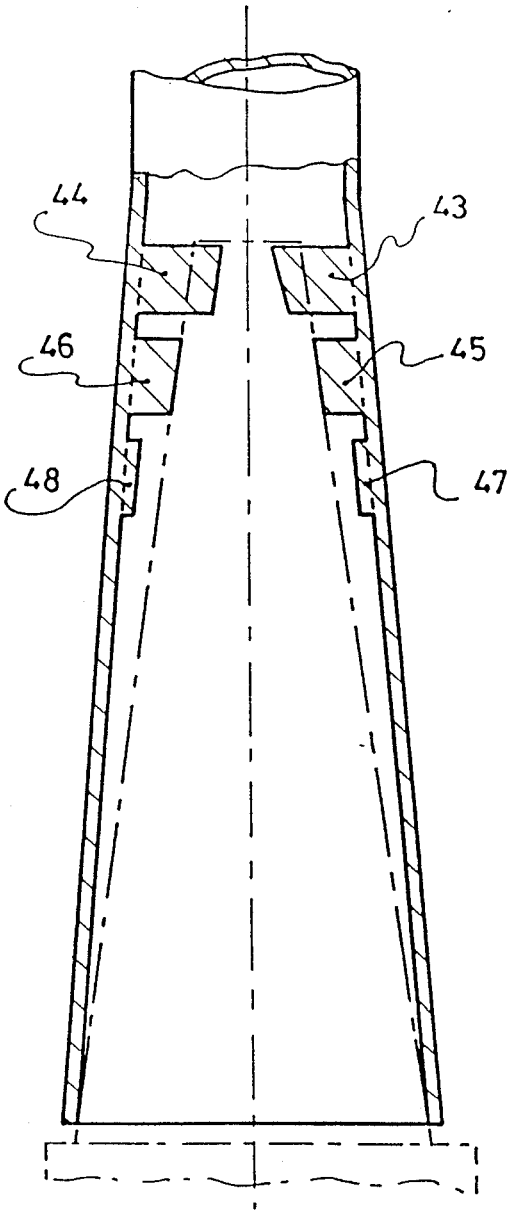
FIG. 9 is a view similar to FIG. 6 showing another embodiment of the invention.

In the same way, in the process according to the invention, the projections 43, 44, 45, 46, 47, 48 can be provided on the exterior assembly part 22, instead of on the interior part 40, as shown in FIG. 9.

It will be easily understood that the projections serving to modify the support points can be constructed on an intermediate part placed between the interior assembly part and the internal wall of the exterior assembly part.

Also, the assembly process according to the invention is not limited to an application to putters but can also be used for the mounting of other types of clubs such as irons or woods.

Finally, it is to be understood that the invention is not be limited to the particulars of the preferred embodiments, but extends to all equivalents within the scope of following claims.

We claim:

1. A golf club comprising:

(a) a shaft having a means for supporting a head, said supporting means being rigidly affixed to said shaft;

(b) a head for attachment to said shaft, said head having means for engaging said supporting means of said shaft and further comprising a neck;

wherein said supporting means of said shaft and said engaging means of said head comprise a plurality of projections on one of said supporting means and said engaging means and further comprise means for selectively positioning a first single longitudinal axis passing through said shaft at one of a plurality of predetermined angles relative to a second longitudinal axis passing through said neck as said shaft and said head are attached.

2. The golf club of claim 1 wherein said shaft comprises an external assembly part and said supporting means of said shaft comprises an internal surface area of said external assembly part; wherein said neck forms an internal assembly part and said engaging means of said head comprises an external surface area of said internally assembly part; and wherein said internal assembly part is receivable within said external assembly part.

3. The golf club of claim 2, wherein said engaging means of said head comprises means for engaging only a predetermined portion of said internal surface area of said external assembly part.

4. A golf club comprising:

(a) a shaft having a means for supporting a head, said supporting means comprising an internal surface area of an external assembly part and being rigidly affixed to said shaft;

(b) a head for attachment to said shaft, said head comprising an external surface area of an internal assembly part, wherein said internal assembly part is receivable within said external assembly part and is engageable with said internal surface area of said external assembly part of said shaft, wherein said external surface area of said internal assembly part comprises means for engaging only a predetermined portion of said internal surface area of said external assembly part;

wherein said supporting means of said shaft and said engaging means of said head comprise a plurality of projections on one of said supporting means and said engaging means and further comprise means for selectively positioning a first single longitudinal axis passing through said shaft at one of a plurality of predetermined angles relative to a second longitudinal axis passing through said internal assembly part as said shaft and said head are attached, wherein said predetermined portion varies in response to which of said plurality of predetermined angles between said first and second axes is formed.

5. The golf club of claim 1, wherein said neck forms an internal assembly part and said shaft comprises an internal assembly part, and wherein said projections are formed on said internal assembly part.

6. The golf club of claim 1, wherein said neck forms an internal assembly part and said shaft comprises an external assembly part, and wherein said projections are formed on said external assembly part.

7. The golf club of claim 5, wherein a plurality of said projections are provided for each of said plurality of predetermined angles, and wherein said projections are substantially uniformly and angularly distributed on the periphery of said internal assembly part of said head.

8. The golf club of claim 7, wherein said plurality of projections provided for each of said plurality of predetermined angles equal two projections which are disposed substantially on opposite sides of said internal assembly part of said head.

9. The golf club of claim 7, wherein each of said plurality of projections which are provided for each of said plurality of predetermined angles comprises a respective support surface envelope having a longitudinal axis which is inclined with respect to said second longitudinal axis of said internal assembly part which corresponds to a respective one of said predetermined angles.

10. The golf club of claim 9, wherein each of said support surface envelopes has a substantially conical configuration.

11. The golf club of claim 10, wherein said supporting means of said shaft comprises an internal support surface of said external assembly part, and wherein said internal support surface comprises two substantially oppositely disposed, substantially flat surfaces.

12. The golf club of claim 5, wherein a plurality of said projections are provided for each of said plurality of predetermined angles, and wherein said projections are substantially uniformly and angularly distributed on the periphery of said external assembly part of said shaft.

13. The golf club of claim 12, wherein said plurality of projections provided for each of said plurality of predetermined angles equal two projections which, are disposed substantially on opposite sides of said external assembly part of said shaft.

14. The golf club of claim 12, wherein each of said plurality of projections which are provided for each of said plurality of predetermined angles comprises a respective support surface envelope having a longitudinal axis which is inclined with respect to said first single longitudinal axis of said external assembly part which corresponds to a respective one of said predetermined angles.

15. The golf club of claim 2, comprising interstices between said external assembly part and said internal assembly part, and further comprising a quantity of glue for affixing said external assembly part to said internal assembly part.

16. The golf club of claim 2, wherein said external assembly part has an external surface which is substantially uninterrupted.

17. The golf club of claim 16, wherein said substantially uninterrupted surface is substantially smooth.

18. A head for a golf club for attachment to a shaft for said golf club, wherein said head comprises means for engaging a supporting means on the shaft, wherein said head comprises a neck and said engaging means of said head comprises at least three support projections arranged in series on each of two opposite sides of said neck to define three pairs of engagement members for selectively positioning a first single longitudinal axis passing through said shaft at defining one of three of a plurality of predetermined angles relative to a second longitudinal axis passing through said neck as said shaft and said head are attached.

19. The golf club head of claim 18, wherein said supporting means of said shaft comprises an internal surface area, and wherein each of said three pairs of engagement members define in part a substantially conical envelope corresponding to an envelope defined in part by said internal surface area of said supporting means of said shaft.

20. The golf club head of claim 19, wherein said substantially conical envelope defined by each of said pairs of engagement members has an angle of approximately 10°.

21. The golf club head of claim 20, wherein each of said substantially conical envelopes has a longitudinal axis, and wherein adjacent ones of said substantially conical envelopes are positioned at an angle of approximately 1.5° with respect to each other.

22. The golf club head of claim 21, wherein one of said longitudinal axes of said substantially conical envelopes is substantially coaxial with said second longitudinal axis of said neck.

23. The golf club head of claim 18, further comprising a weakened zone in the area of juncture of each of said support projections and said neck.

24. The golf club head of claim 18, wherein said head is made of synthetic material.

25. The golf club head of claim 18, wherein said neck has a substantially oval cross-section.

26. The golf club head of claim 25, wherein said neck has a generally conical shape having flattened areas on opposite sides.

27. A golf club having the golf club head of claim 26, further comprising a shaft having a generally conical shape within which said head is receivable, wherein said generally conical shape of said shaft has flattened areas on opposite internal sides for positioning against the flattened areas on said opposite sides of said golf club head.

28. A method of assembling the golf club shaft and head of claim 1 comprising the steps of selectively positioning said shaft relative to said head and selectively positioning said first single longitudinal axis passing through said shaft at one of a plurality of predetermined angles relative to said second longitudinal axis as said shaft and said head are attached.

29. The method of claim 28, wherein said step of selectively positioning said shaft and said head comprises inserting a portion of said head into a portion of said shaft.

30. The method of claim 28, wherein said step of selectively positioning said shaft and said head comprises modifying the engaging means of said head prior to attaching said shaft and said head.

31. A method of assembling a golf club shaft and head, in which said golf club includes a shaft having a means for supporting a head said supporting means being rigidly affixed to said shaft, a head for attachment to said head, said head having means for engaging said supporting means of said shaft, and a neck wherein said engaging means of said head comprises a plurality of engaging members on one of said supporting means and said engaging means corresponding to each of a plurality of predetermined angles formed between a first single longitudinal axis passing through said shaft and a second longitudinal axis passing through said neck as said shaft and said head are attached, said method comprising:

modifying said engaging means of said head comprising retaining only the ones of said engaging members which correspond to a desired one of said plurality of predetermined angles;

selectively positioning said first single longitudinal axis passing through said shaft at said one of a plurality of predetermined angles relative to said second longitudinal axis passing through said neck as said shaft and said head are attached.

32. The method of claim 31, further comprising the step of providing a quantity of glue between said shaft and said head for retaining said head on said shaft.

* * * * *